US005927254A

United States Patent [19]

Ino et al.

[11] Patent Number: 5,927,254

[45] **Date of Patent: *Jul. 27, 1999**

[54] INTAKE DUCT AND INTAKE SYSTEM FOR INTERNAL COMBUSTION ENGINE

[75] Inventors: Masao Ino, Toyota; Yoshitaka Nishio, Nagoya; Toshiaki Nakayama, Nishikamo-gun; Akihide Yamaguchi; Shuya Mikami, both of Kariya, all of Japan

[73] Assignee: Denso Corporation, Kariya, Japan

[ * ] Notice: This patent is subject to a terminal disclaimer.

[21] Appl. No.: 08/783,285

[22] Filed: Jan. 10, 1997

[30] Foreign Application Priority Data

Jan. 25, 1996 [JP] Japan ..... 8-011247

[51] Int. Cl.[6] ..... F02M 55/02; F01P 1/06

[52] U.S. Cl. ..... 123/470; 123/41.31; 123/184.61; 123/541

[58] Field of Search ..... 123/468, 456, 123/41.31, 541, 198 D, 469, 470, 471, 184.34, 184.42, 184.61, 184.24, 184.21

[56] References Cited

U.S. PATENT DOCUMENTS

| | | | |
|---|---|---|---|
| 3,783,842 | 1/1974 | Kuhn | 123/470 |
| 4,702,202 | 10/1987 | Hensel | 123/184.24 |
| 5,003,933 | 4/1991 | Rush | 123/184.61 |
| 5,211,139 | 5/1993 | Houle | 123/184.61 |
| 5,309,885 | 5/1994 | Rawlings | 123/541 |
| 5,357,931 | 10/1994 | Semence | 123/184.61 |
| 5,398,656 | 3/1995 | Brisbane | 123/470 |
| 5,575,247 | 11/1996 | Nakayama et al. . | |
| 5,595,151 | 1/1997 | Powell | 123/184.61 |
| 5,664,533 | 9/1997 | Nakayama | 123/184.42 |

FOREIGN PATENT DOCUMENTS

| | | | |
|---|---|---|---|
| 0 523 027 A2 | of 1993 | European Pat. Off. . | |
| 63-100269 | of 1988 | Japan . | |
| 63-183365 | of 1988 | Japan . | |
| 6159088 | 6/1994 | Japan | 123/541 |
| 658702 | 11/1986 | Switzerland | 123/184.21 |

*Primary Examiner*—Carl S. Miller
*Attorney, Agent, or Firm*—Nixon & Vanderhye P.C.

[57] ABSTRACT

Fuel supply devices for an engine are disposed within an intake duct located upstream of an air cleaner. Thus, the fuel supply devices such as fuel injection valves and a fuel supply pipe are always cooled by intake air flow while the engine is being driven. In addition, heat conducted from the engine to the fuel supply device can be insulated by the intake duct when the engine is stopped. Further, since the intake duct located upstream of the air cleaner does not dispose functional parts such as a filter therein, a high degree of freedom for mounting the intake duct on the engine is maintained so that the intake duct can be easily disposed at the position where the fuel supply devices are located.

23 Claims, 6 Drawing Sheets

INTAKE DUCT AND INTAKE SYSTEM FOR INTERNAL COMBUSTION ENGINE

CROSS-REFERENCE TO RELATED APPLICATION

This application is related to and claims priority from Japanese Patent Application No. Hei. 8-11247, filed on Jan. 25, 1996, the contents of which are hereby incorporated by reference.

BACKGROUND OF THE INVENTION

1. Field of the Invention

The present invention relates to the intake system of an internal combustion engine, and more particularly to an intake duct in which fuel system parts such as a fuel supply pipe and a fuel injection valves are disposed at the an upstream side of an air cleaner.

2. Description of Related Art

When fuel temperature rises during an engine stop page fuel, vapor is generated. As a result, fuel supply to the engine becomes unstable in engine re-starting, and a defective engine start may be caused. To prevent this problem, it is necessary for the fuel temperature supplied to the engine to be maintained as low as possible to suppress vapor from being generated.

Conventionally, various methods of cooling fuel system parts such as the fuel injection valves, by means of engine intake air have been proposed. For example, in EP-0523027A2 and JP-A-63-100269, a fuel supply device such as the fuel injection valve is located within the air cleaner, so that the fuel supply device such as the fuel injection valve is cooled by intake air flowing through the air cleaner.

Further, in JP-U-63-183365, a fuel supply device including a fuel injection valve and a fuel supply pipe is disposed within a duct placed between the downstream side of an engine air cleaner and the upstream side of an intake manifold, so that the fuel supply device is cooled by intake air flowing through the duct.

However, in EP-0523027A2 and JP-A-63-100269, because the fuel supply device such as the fuel injection valve is located within the air cleaner, the locations where the air cleaner can be mounted are restricted due to the restriction of where the fuel supply device such as the fuel injection valve can be mounted. That is, the air cleaner is not freely located, and it is difficult for the air cleaner to be located in, for example, a narrow engine compartment of a vehicle.

Further, in JP-U-63-183365, since the fuel supply device is disposed within duct located downstream of the engine air cleaner, clean intake air passes through the duct. Therefore it is necessary for connections with the fuel supply device to have a strictly-airtight structure to prevent the in flow of polluted outside air which is not filtered. Thus, product cost becomes high, with the result that the method is not practically employed. In JP-P-63-100269, the fuel supply device is also located downstream of the air cleaner filter thereby causing the same problems.

SUMMARY OF THE INVENTION

In view of the foregoing problems, it is an object of the present invention to provide an intake duct and an intake system which can cool a fuel supply device by means of intake air flow while yet maintaining a high degree of freedom for possible mounting locations on the engine.

According to one aspect of the present invention, the intake system for the engine includes an intake duct upstream of the air cleaner and an attachment portion for accommodating and attaching a fuel supply device into the intake duct. Therefore, the fuel supply device is always cooled by intake air flowing through the intake duct while the engine is being driven, and heat conducted from the engine to the fuel supply device can be partly insulated by the intake duct, so that the fuel supply device can be easily maintained at a low temperature. Further, since the intake duct located upstream of the air cleaner does not dispose functional parts such as a filter therein, a high degree of freedom for mounting the intake duct on the engine is maintained so that the intake duct can be easily disposed at the position where the fuel supply device is located.

Further, the fuel supply device is disposed within the intake duct upstream of the air cleaner, i.e., the dust side. Therefore, even when outside air may be mixed into the intake duct from the attachment portion, it does not cause any problems. Thus, the attachment portion does not require a strictly-airtight seal structure, and the manufacturing cost can be reduced as well.

According to another aspect of the present invention, the attachment portion of the fuel supply device includes an opening portion located on the intake duct and a cover member for opening and closing the opening portion, a part of the fuel supply device may be detachably disposed within the intake duct. Thus, the fuel supply device can be easily maintained and checked, and assembling effeciency of the fuel supply device can be improved.

Further, the cover portion may be pivotally connected to the intake duct by a hinge portion so that the cover member can easily open and close the opening portion.

Preferably, the intake duct may be made of an elastic material, the attachment portion may be constituted by a slit shaped opening, and a part of the fuel supply device may be press-fitted into the intake duct therethrough. Thus, the intake duct can be constituted by one integrally molded duct so that the manufacturing cost of the intake duct can be decreased.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PRESENTLY PREFERRED EXEMPLARY EMBODIMENTS

Preferred embodiments of the present invention are described hereinafter with reference to the accompanying drawings.

A first embodiment of the present invention will be described.

Figure 1:
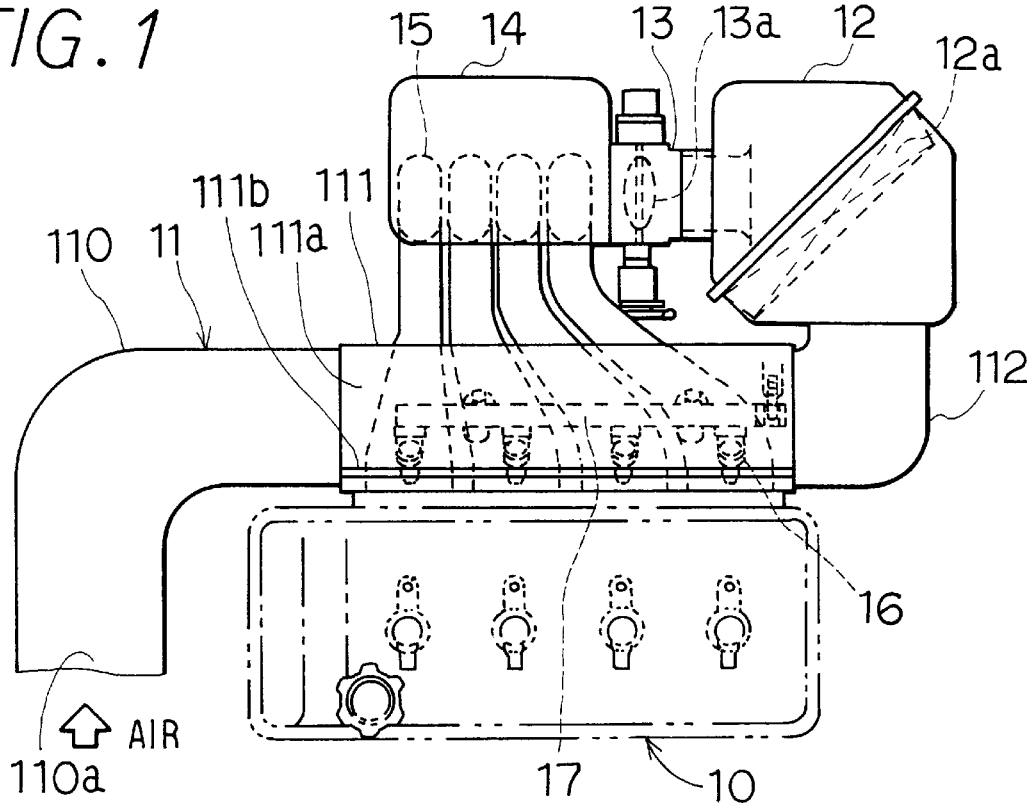
FIG. 1 is a top plan view of an intake system of an engine in accordance with a first embodiment of the present invention.
Figure 2:
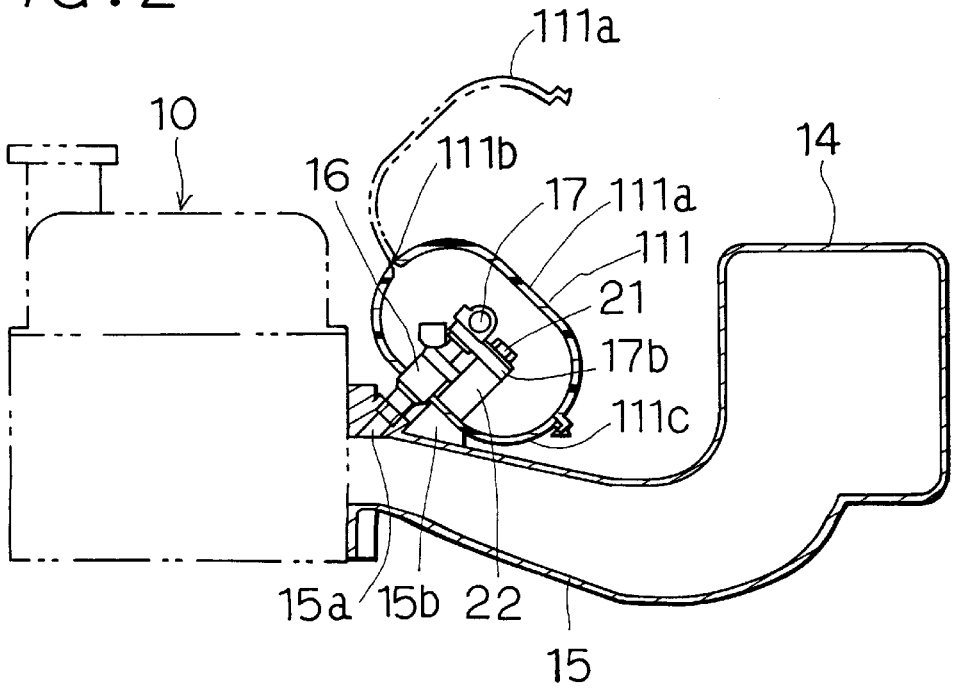
FIG. 2 is a partial cross-sectional view of the intake system in FIG. 1.
Figure 3:
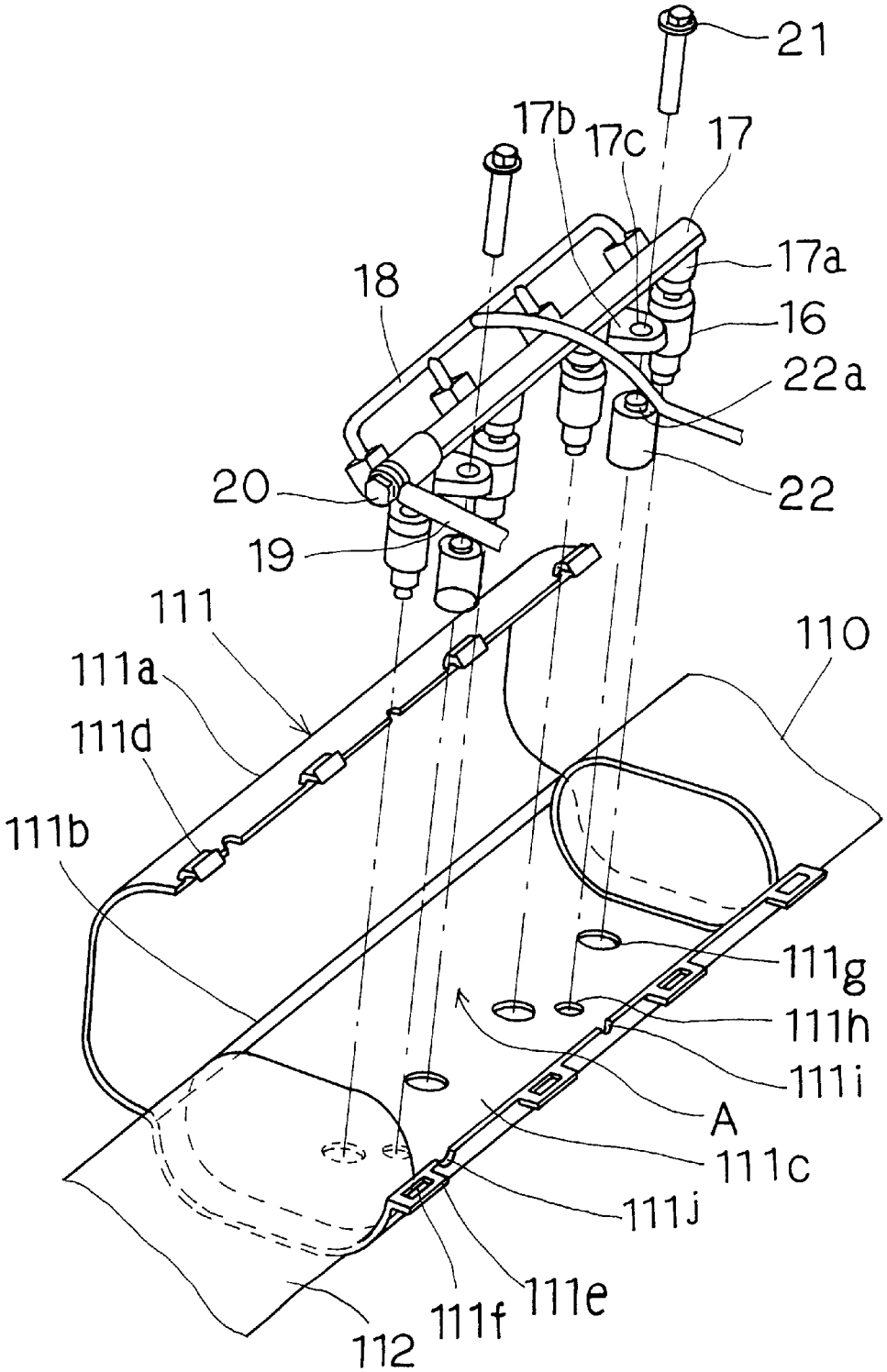
FIG. 3 is a partial exploded view of the intake system in FIG. 1.

FIGS. 1 through 3 show an intake system of an internal combustion engine for a vehicle according to the first embodiment of the present invention. The engine body 10 is of a four-cylinder type in the first embodiment, and an intake duct 11 is adjacently disposed just at the side of the engine body 10. The intake duct 11 is formed by connecting three ducts 110, 111 and 112 in the first embodiment. The intake duct 11 is located at an upstream side of an air cleaner 12 for filtering intake air of the engine, and air flowing from an inlet 110*a* is directed into the air cleaner 12.

As shown in FIG. 1, the duct 112 at the most downstream side of the intake duct 11 is curved at a right angle in a direction as to be away from the engine body 10, the air cleaner 12 is located at the top end portion of the duct 112. A filter member 12*a* for filtering the intake air is disposed within the air cleaner 12. The filter member 12*a* has a well known structure of filtering the intake air by using a filter material such as an un-woven fabric and a filter paper.

A throttle body 13 and a surge tank 14 are disposed at a downstream side of the air cleaner 12, the throttle body 13 and the surge tank 14 are parallel to the duct 111 placed at a middle portion in the intake duct 11, and a throttle valve 13*a* is disposed within the throttle body 13. The surge tank 14 decreases intake pulsations at the downstream side of the throttle body 13.

As shown in FIG. 2, an inlet of an intake manifold 15 is connected to a bottom side of the surge tank 14, the intake manifold 15 is extended toward the engine body 10 while passing under the middle portion duct 111 of the intake duct 11. That is, the intake manifold 15 and the middle portion duct 111 of the intake duct 11 are disposed so as to cross each other. The intake manifold 15 is connected to the engine body 10 by a bolt (not shown), for example.

Next, the fuel supply device part will be specifically described. As shown in FIG. 2, the middle portion duct 111 of the intake duct 11 is elliptically formed from an elastic synthetic resin such as polypropylene and polyethylene. One end portion of circular direction of an upper side semi-cylinder portion 111*a* of the middle portion duct 111 is rotatably connected to the remaining semi-cylindrical portion 111*c* through a hinge portion 11*b*. The wall thickness of the duct is partly thin-walled so that the hinge portion 111*b* is formed to rotate the semi-cylindrical portion 111*a* easily.

A plurality of engagement claws (four claws in FIG. 3, for example) are integrally formed with the other end portion in the circumferential direction of the semi-cylindrical portion 111*a*. Corresponding to the engagement claws, a plurality of flange portions 111*e* are integrally formed at the other end portion of the remaining semi-cylindrical portion 111*c*. A plurality of engagement holes 111*f* are opened in the flange portions 111*e*, and the engagement claws are respectively inserted and engaged into the engagement holes.

In the first embodiment, the upper side semi-cylinder portion 111*a* of the middle portion duct 111 can be opened through the hinge portion 111*b* (refer to two-dot chain line in FIG. 2 and FIG. 3) so that an opening portion A for opening the inside portion of the duct to the outside is formed. The opening portion A is formed in a rectangular opening extending in an axial direction of the duct for accommodating the fuel supply devices described later into the middle portion duct. The upper side semi-cylindrical portion 111*a* constitutes a cover member for closing the opening portion A.

Four fitting holes 111*g* for the fuel injection valves 16 are formed substantially at a central portion of a peripheral surface of the semi-cylindrical portion 111*c* of middle portion duct 111 so as to pass therethrough as shown in FIG. 3. Further, two fitting holes 111*h* for spacers 22 are formed adjacent to the fitting holes 111*g* so as to pass therethrough. The spacers 22 are cylindrically molded resin. Small-diameter portions are formed at two end portions of the spacers 22 (lower side small-diameter portions are not shown in FIG. 3), and the small-diameter portions 22*a* are inserted into the fitting holes 111*h*.

The fuel supply pipe (distribution pipe) 17 for supplying fuel to the four fuel injection valves 16 has branch pipe portions 17*a* corresponding to each fuel injection valve 16. The top small-diameter portions of the branch pipe portions 17*a* are respectively fitted into opening portions which are opened at the fuel inlet side end portion (upper side portion) of each fuel injection valve 16. Further, two installation flange portions 17*b* are integrally formed with the fuel distribution pipe 17 at positions which are close to two end portions of the fuel distribution pipe 17. The upper side small-diameter portions 22*a* of the spacers 22 are inserted into the installation holes 17*c* opened in the installation flange portions 17*b*.

The fuel injection valve 16 has an electromagnetic type structure in which the valve opening time is automatically controlled by a fuel injection control device, and a lead wire 18 for inputting electric signals to an electromagnetic coil portion (not shown) is electrically connected to the fuel injection valves 16. A hole 111*i* through which the lead wire 18 is taken out is formed at the engagement side end portions of two the semi-cylindrical portions 111*a* and 111*c*.

Further, a fuel supply pipe 19 for introducing fuel pumped from a fuel pump (not shown) into the fuel distribution pipe 17 is connected to the one end side of the fuel distribution pipe 17 by a bolt 20. The fuel supply pipe 19 is disposed perpendicularly to the axial direction of the fuel injection valve 16. Similar to the hole 111*i*, a hole 111*j* through which the fuel supply pipe 19 is taken out is formed at the engagement side end portions of two the semi-cylindrical portions 111*a* and 111*c*.

As shown in FIG. 2, a fuel injection passage 15*a* into which the top small portion of the fuel injection valve 16 is assembled is located at the intake manifold 15, and an installation seat 15*b* on which the fuel injection valves 16 and the fuel supply pipe 17 are integrally fastened is located in the semi-cylindrical portion 111*c* of the middle portion duct 111.

Next, a method of assembling the fuel supply device will be described.

Firstly, as shown in FIG. 3, the middle portion duct 111 in a state where the semi-cylindrical portion 111*a* is opened is set at a certain upper side position of the intake manifold 15, the fuel injection valves 16 are accommodated within the duct from the opening portion A, the fuel injection valves 16 are inserted into fitting holes 111*g*, then the top end of the small-diameter portion of each fuel injection valve 16 is inserted into the hole portion of the fuel injection passage 15*a* of the intake manifold 15 (refer to FIG. 2).

The end portion of the top end small-diameter portion of the fuel injection valve 16 is contacted with the end surface of the hole portion of the fuel injection passage 15*a* so that the position where the fuel injection valve 16 is inserted is fixed. Further, an elastic seal member made of a rubber type material is interposed between the end portion of the top end small-diameter portion of the fuel injection valve 16 and the end surface of hole portion of the fuel injection passage 15*a* (not shown), so that the outside air can be prevented from flowing into the intake manifold 15.

Next, the small-diameter portion of the top end of each branch pipe portion 17*a* of the fuel supply pipe 17 connected to the fuel supply pipe 19 is inserted into the opening portion of the fuel inlet side end portion (upper end portion) of each the fuel injection valve 16. Then, the lower side small-diameter portion (not shown) of the spacers 22 is inserted into the fitting holes 111*h,* the upper side small-diameter portions 22*a* of the spacers 22 are inserted into the installation holes 17*c* of the installation flange portions 17*b* of the fuel supply pipe 17.

Next, a male screw portion of the bolts 21 are inserted into the installation holes 17*c* of the installation flange portions 17*b* and the cylindrical spacers 22, and the top end portion of the male screw portion of the bolts 21 are screwed into the screw holes (not shown) of the installation seat 15*b* of the intake manifold 15. By means of the fastening force of bolt 21, three parts of the semi-cylindrical portion 111*c* of the middle portion duct 111, the fuel injection valves 16 and the fuel supply pipe 17 can be fastened and fixed to the installation seat 15 at the same time.

Next, the lead wire 18 is connected to each fuel injection valve 16 so that the assembling steps for accommodating the fuel supply device within the middle portion duct 111 can be finished.

Lastly, the lead wire 18 is fit into the hole 111*i,* and the fuel supply pipe 19 is fit into the hole 111*j.* Then, the two semi-cylindrical portions 111*a* and 111*c* are integrally connected with each other by engaging the engagement claws 111*d* and the engagement holes so that all assembling steps are finished.

In the first embodiment of the present invention, because the intake duct 11 is located at the upstream side of air cleaner 12, outside air may be mixed into duct 11 from the connecting portion of the two semi-cylindrical portions 111*a* and 111*c*. Thus, it is not necessary for a strictly-airtight seal structure to be formed at the connecting portion. As described above, the two end portions of the semi-cylindrical portions 111*a* and 111*c* may be contacted with and engaged by only an elastic of a resin.

Next, an operation according to the above-described structure will be described. When the engine is driven, outside air is sucked from an inlet portion 110*a* of intake duct 11, intake air passes through ducts 110, 111 and 112 and further flows into air cleaner 12. By means of filter member 12*a* of air cleaner 12, dust and the like are filtered. The flow amount of clean intake air filtered in the air cleaner 12 is adjusted by throttle valve 13*a,* the pulsations of intake air absorbed in surge tank 14. Then, intake air is sucked into each cylinder of engine body 10 through intake manifold 15.

On the other hand, the fuel pumped by the fuel pump (not shown) is introduced into the fuel supply pipe 17 through fuel supply pipe 19. Then, fuel in the fuel supply pipe 17 is distributed into each branch pipe portion 17*a,* and fuel flows into each fuel injection valve 16. The fuel is injected to fuel injection passage 15*a* of intake manifold 15 by appropriately controlling the valve opening time of each fuel injection valve 16 with the electric control means. The fuel and air are mixed in the intake manifold 15, and mixture is directed into each cylinder of engine body 10.

Because parts of the fuel supply devices, such as the fuel injection valves 16 and the fuel supply pipes 17 and 19, are located within the middle portion duct 111 of intake duct 11, heat conducted from engine body 10 to the fuel system parts can be insulated (softened) by the middle portion duct 111. Further, while the engine is being driven, the fuel system parts are always cooled by intake air flowing through the middle portion duct 111. Therefore, the fuel system parts can be maintained at a comparatively low temperature, and the fuel temperature within the parts can be also maintained at a low temperature.

As a result, the possibility that the fuel temperature rises and vapor is generated in the fuel after the engine has been stopped may be reduced greatly, and the re-starting performance of the engine can be improved.

Figure 4:
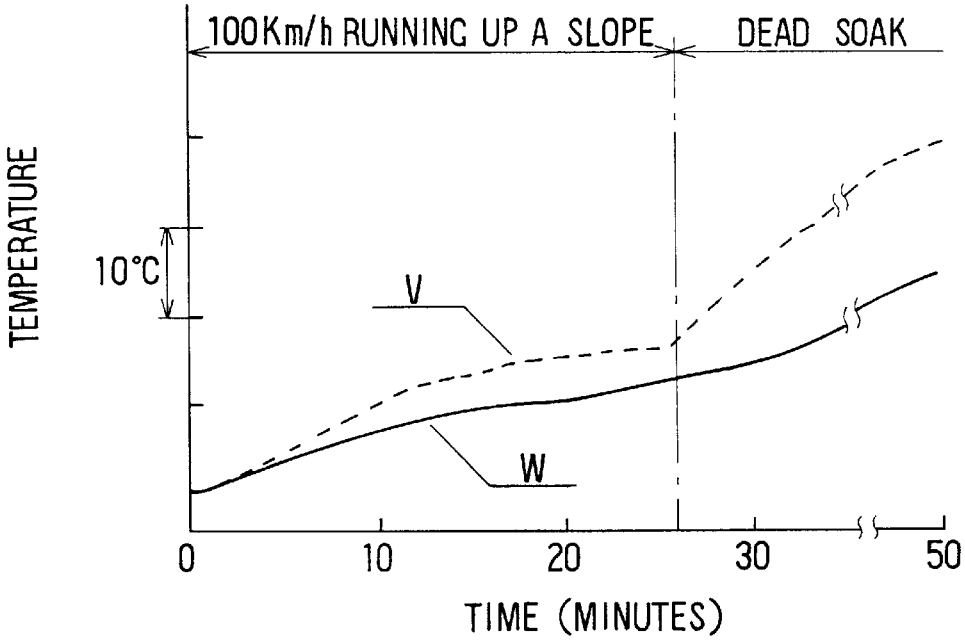
FIG. 4 is a graph showing insulating and cooling effects of a fuel system parts according to the first embodiment.

FIG. 4 is a graph showing effects of insulating and cooling fuel system parts according to the first embodiment. The experiment in FIG. 4 shows the changes of the surface temperature of the fuel system parts (specifically, fuel supply pipe 17) while the vehicle is travelling in a slope (a high load) at 100 km/h speed and when the engine is stopped after the high load travelling. In FIG. 4, the characteristic V shown by a broken line represents a comparative example in which the fuel system parts are located outside the intake duct. On the other hand, the characteristic W shown by a solid line represents the first embodiment in which the fuel system parts are accommodated in the intake duct 11. The temperature of the surface of the fuel supply pipe 17 of the first embodiment can be maintained to be lower than the comparative example by approximately 15° C. when 50 minutes has elapsed.

Figure 5:
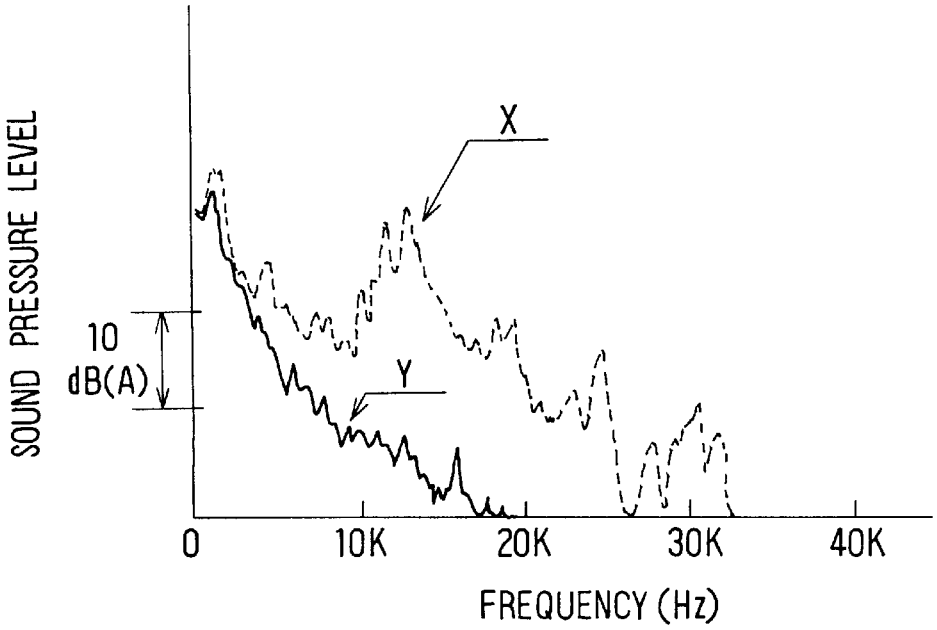
FIG. 5 is a graph showing a decreased effect of an operating noise of a fuel injection valve according to the first embodiment.

Further, each fuel injection valve 16 is accommodated within the intake duct 11 so that operational noise caused by opening-closing the fuel injection valves 16 can be decreased. FIG. 5 is a graph showing decreased noise effect from the fuel injection valves. The characteristic X shown by a broken line represents a comparative example in which the fuel system parts are located outside the intake duct. On the other hand, the characteristic Y shown by a solid line is the first embodiment in which the fuel system parts are accommodated within the intake duct 11. As shown in FIG. 5, the method of the first embodiment can decrease the operational noise of the fuel injection valves a wide frequency range.

Further, because the fuel system parts are accommodated within the intake duct 11 located at the upstream side of air cleaner 12, it is not necessary for a strictly-airtight seal structure to be located at the connecting portion between the two semi-cylindrical portions 111*a* and 111*c* as described above. Thus, at the fitting portions between the lead wire 18, the fuel supply pipe 19, each the fuel injection valve 16, the spacer 22, etc., and the semi-cylindrical portions 111*a* and 111*c,* a strictly-airtight seal structure is not required. Therefore, a simple fitting structure as shown in FIG. 3 can be employed.

Further, because the intake duct 11 simply forms an intake passage, and the other functional parts are not disposed therein, a fuel drain hole for accommodating any fuel leakage can be easily located.

Further, since the intake duct 11 simply forms the intake passage as described above, the intake duct 11 has an extremely high degree of freedom for being mounted and connected as compared with the air cleaner 12. Therefore, the layout for accommodating the fuel system parts into the intake duct can be easily employed in various types of engines. Further, because the air cleaner 12 does not dispose fuel system parts therein, a high degree of freedom for its installation position is maintained high so that the mounting performance of the entire intake system can be greatly improved.

Further, the middle portion duct 111 accommodating the fuel system parts is constituted by the two semi-cylindrical portions 111*a* and 111*c* which are connected while being freely opened and closed. Therefore, when the semi-cylindrical portion 111*a* is opened as shown in FIGS. 2 and 3, the middle portion duct 111 is detached from the other ducts 110 and 112, so that the fuel system parts can be easily maintained and checked even after the vehicle is completed. In addition and also the fuel system parts can be easily assembled.

A second embodiment of the present invention will be described.

Figure 6:
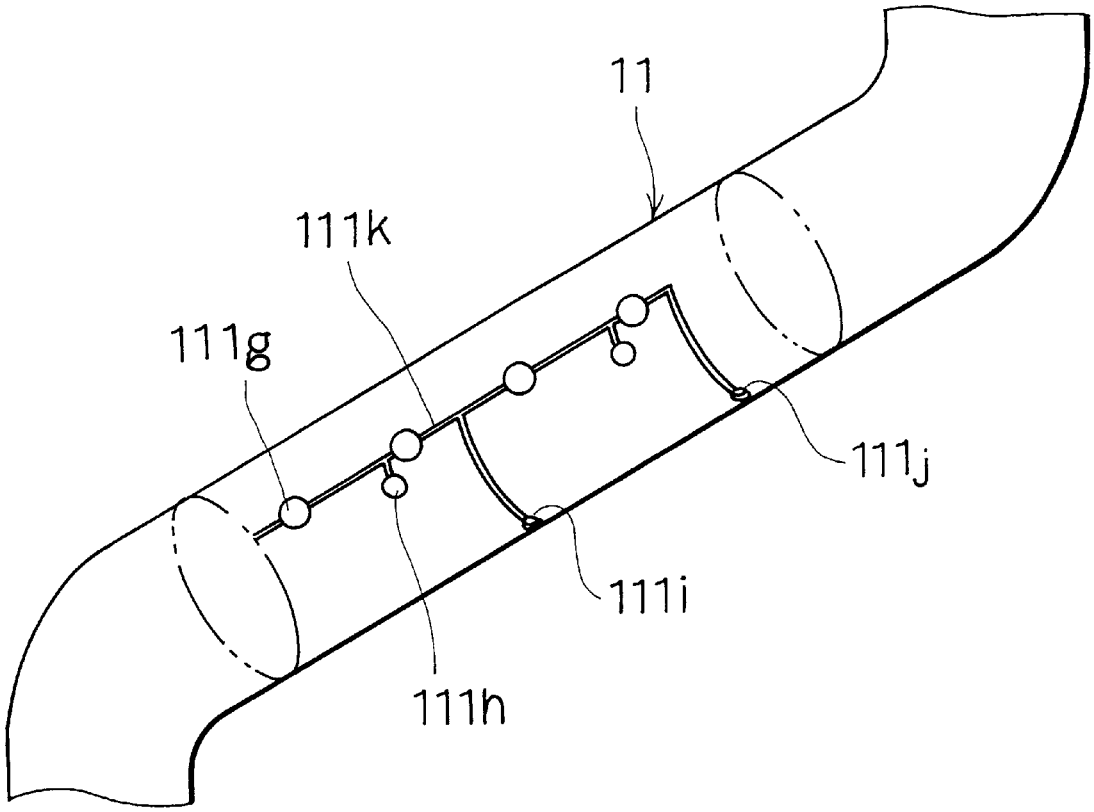
FIG. 6 is a perspective view of an intake duct according to a second embodiment of the present invention.

In the first embodiment, the intake duct 11 is constituted by the distributed ducts 110, 111 and 112, however, in the second embodiment, as shown in FIG. 6, in the second embodiment, an intake duct 11 is constituted by one duct which is integrally molded. The intake duct 11 is molded with a resin having an elasticity to some extent. A slit shaped opening portion 111*k* is formed on the intake duct 11 to connect spacer fitting holes 111*h*, fuel injection valve fitting holes 111*g* and a lead wire hole 111*i*.

The slit shaped opening portion 111*k* is cut in the wall surface of the duct made of an elastic material, and the opposing end surfaces of the wall surface of the duct 11 through the slit shaped opening portion are tightly contacted with each other by the elasticity of the duct 11.

In the second embodiment, the fuel system parts 17 to 19 are assembled to the intake manifold 15 side by using the spacer 22 and the bolt 21 described in FIG. 3, and then the intake duct 11 is press-fitted into the assembled fuel system parts from upper side thereof. The peripheral portion of the slit shaped opening portion 111*k* of the intake duct 11 is elastically transformed so that the fuel system parts are accommodated within the intake duct 11.

In the same manner as the first embodiment, through the holes 111*g*, 111*h*, 111*i* and 111*j*, the fuel system parts can be taken out to the outside of the duct 11.

According to the second embodiment of the present invention, because the duct 11 can be constituted by only one duct which is integrally molded, the manufacturing cost of the intake duct 11 can be decreased, and the assembly of the fuel system parts is simplified.

A third embodiment of the present invention will be described.

Figure 7:
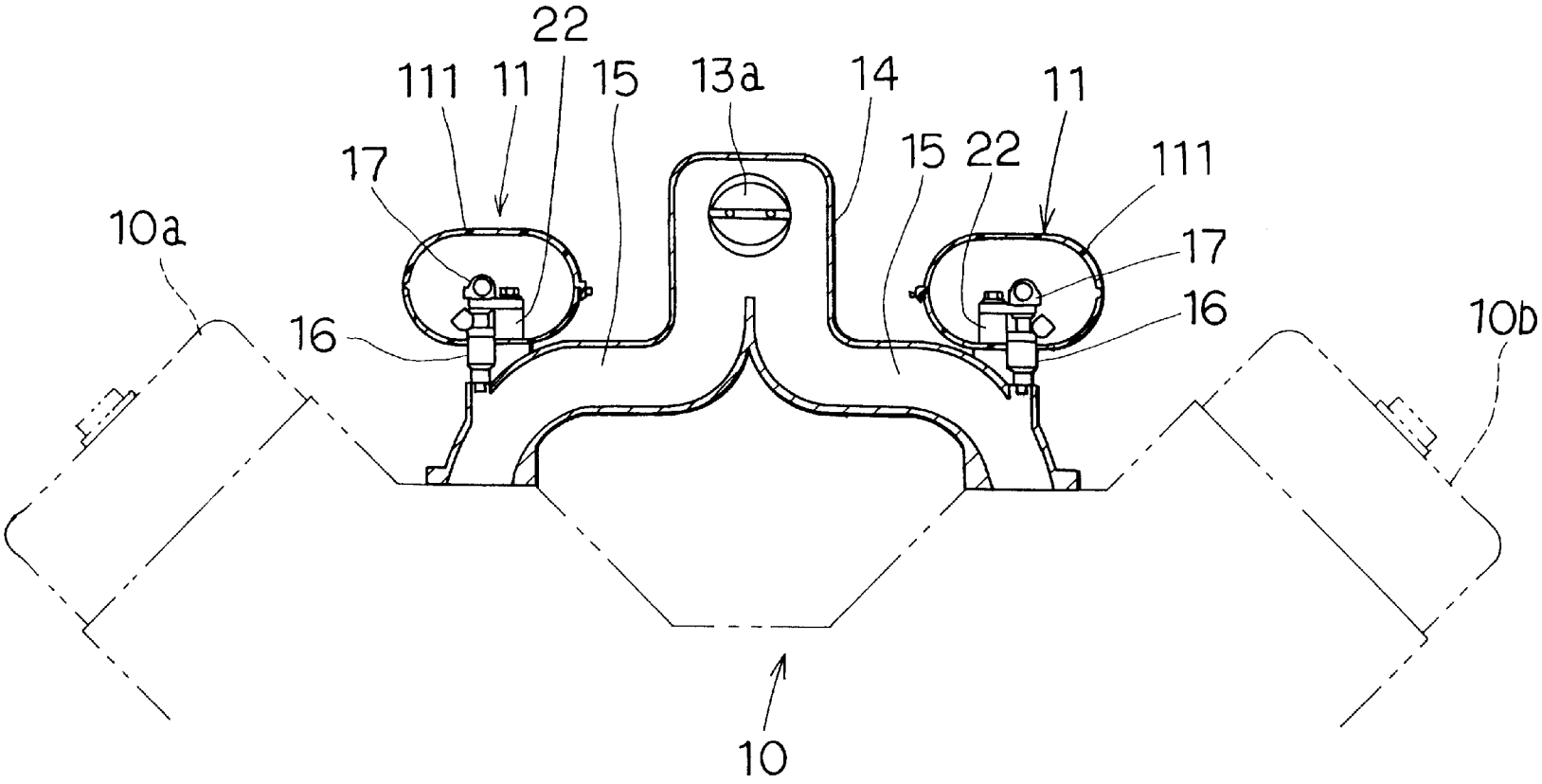
FIG. 7 is a cross-sectional view illustrating a main portion where a V-type engine is disposed according to a third embodiment of the present invention.

In the third embodiment, the intake duct of the present invention is employed in a V-type engine as shown in FIG. 7. In the V-type engine, the engine body 10 has a first cylinder portion 10*a* and a second cylinder portion 10*b* which are connected to each other in a V-shape. Two fuel supply devices are independently disposed in the respective first cylinder portion 10*a* and second cylinder portion 10*b*.

Further, two intake ducts 11 located upstream of the air cleaner 12 (not shown in FIG. 7) are respectively disposed on the first cylinder side 10*a* and the second cylinder side 10*b* so as to be parallel with each other. Outside air sucked from the two intake ducts 11 is filtered in the air cleaner 12, then the cleaned air is directed into the surge tank 14 through a throttle valve 13*a*.

Both the intake duct 11 have the middle portion ducts 111 as shown in FIG. 3, and the fuel system parts 16, 17 and 19 are assembled to the middle portion duct 111 in the same manner as in the first embodiment.

Thus, according to the third embodiment, in the V-type engine, the same effects can be obtained as in the first embodiment.

A fourth embodiment of the present invention will be described.

Figure 8:
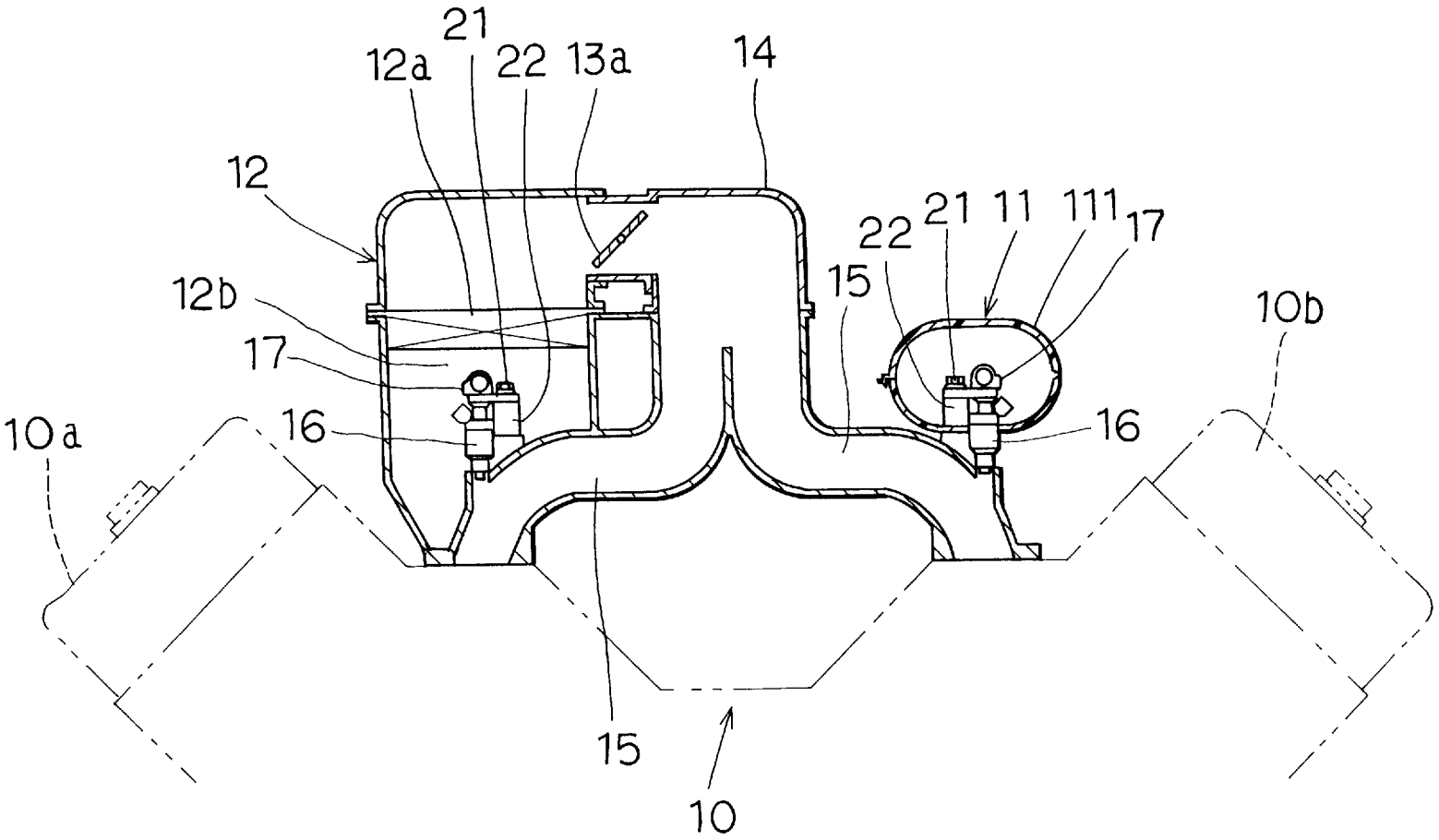
FIG. 8 is a cross-sectional view illustrating a main portion where a V-type engine is disposed according to a fourth embodiment of the present invention.

As shown in FIG. 8, in the fourth embodiment, the present invention is also employed in a V-type engine. In the fourth embodiment, an intake duct 11 is disposed on either one side cylinder portion of the first cylinder portion 10*a* and the second cylinder portion 10*b*, e.g., only on the second cylinder portion 10*b* side. On the first cylinder portion 10*a* side, the fuel type parts 16, 17 and 19 are accommodated within a dust-side opening 12*b* in the air cleaner 12.

Further, the downstream side of the intake duct 11 is connected to the dust-side opening 12*b* of the air cleaner 12. In the fourth embodiment, the fuel system parts 16 and 17 are accommodated within the intake duct 11 on the side of the second cylinder portion 10*b*.

Although the present invention has been fully described in connection with preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. An air intake system which reduces the temperature of combustion fuel supply devices while also supplying combustion air to an internal combustion engine, said system comprising:

a duct disposed to pass intake air along an axial direction towards a downstream air filter; and said duct also encompassing said fuel supply devices therewithin and spaced along said axial direction for cooling by the passage of intake air in the axial direction within said duct while the engine is running and for insulation from engine heat after the engine is stopped, wherein said duct comprises a tubular structure having a side wall portion hinged at one side with detachable connection structures on its other side that are aligned with mated connecting structures on the tubular structure.

2. An air intake system as in claim 1 wherein said tubular structure includes holes in a wall opposite said hinged portion for mounting of said fuel supply devices therethrough.

3. An air intake system as in claim 1 wherein said duct comprises an elastic tubular structure having holes and slits formed along at least one wall through which mounted fuel supply devices are inserted into an interior of the tubular structure.

4. An intake system for introducing intake air into an internal combustion engine, said system comprising:

an air cleaner for filtering intake air;

an intake duct located upstream of said air cleaner forming an air passage through which air flows into said air cleaner, said intake duct having an attachment portion therein; and a fuel supply device disposed within said attachment portion for supplying fuel to said engine;

wherein, said attachment portion includes:

an opening portion formed on a wall surface of said intake duct so as to extend in an axial direction of said intake duct; and a cover member for opening and closing said opening portion.

5. An intake system as in claim 4 wherein said fuel supply device includes a fuel injection valve having a top end and a fuel pipe for supplying fuel to said fuel injection valve.

6. An intake system as in claim 5 wherein said attachment portion includes a first through hole through which said top end of said fuel injection valve passes and a second through hole through which said fuel pipe passes.

7. An intake system as in claim 4 wherein said intake duct is formed by connecting a plurality of ducts.

8. An intake system as in claim 4 wherein a part of said fuel supply device is detachably disposed within said intake duct through said opening portion.

9. An intake system as in claim 4 wherein said attachment portion includes a hinge portion pivotally connecting said cover member to said intake duct.

10. An intake system as in claim 4 wherein said intake duct is made of an elastic material.

11. An intake system as in claim 4 wherein said attachment portion includes a slit-shaped opening opened partially on a wall surface of said intake duct.

12. An intake system as in claim 11, wherein a part of said fuel supply device is press-fitted into said intake duct.

13. An intake system as in claim 5 further comprising:

an intake manifold for directing clean intake air filtered by said air cleaner into said engine, wherein:

said intake duct is disposed adjacent to said intake manifold so as to cross said intake manifold, and said top end of said fuel injection valve is inserted into said intake manifold through said intake duct and a wall surface of said intake manifold.

14. An intake duct forming an air passage for introducing intake air into an internal combustion engine, said intake duct being disposed upstream of an air cleaner for filtering air flowing from said intake duct, said intake duct comprising:

an attachment portion for accommodating and attaching a fuel supply device for said internal combustion engine, wherein said attachment portion is disposed within said intake duct, wherein, said attachment portion includes:

an opening portion formed on a wall surface of said intake duct so as to extend in an axial direction of said intake duct; and a cover member for opening and closing said opening portion.

15. An intake system as in claim 14 wherein said fuel supply device includes a fuel injection valve having a top end and a fuel pipe for supplying fuel to said fuel injection valve.

16. An intake system as in claim 15 wherein said attachment portion includes a first through hole through which said top end of said fuel injection valve passes and a second through hole through which said fuel pipe passes.

17. An intake system as in claim 14 wherein a part of said fuel supply device is detachably disposed within said intake duct through said opening portion.

18. An intake system as in claim 14 wherein said attachment portion includes a hinge portion pivotally connecting said cover member to said intake duct.

19. An intake system as in claim 14 wherein said intake duct is made of an elastic material.

20. An intake system as in claim 14 wherein said attachment portion includes a slit-shaped opening opened partially on a wall surface of said intake duct.

21. An intake system as in claim 20 wherein a part of said fuel supply device is press-fitted into said intake duct.

22. A method for reducing the temperature of combustion fuel supply devices while also supplying combustion air to an internal combustion engine, said method comprising:

passing intake air along a duct in an axial direction towards a downstream air filter; and encompassing said fuel supply devices within said duct and spaced along said axial direction for cooling by the passage of intake air in the axial direction within said duct while the engine is running and for insulation from engine heat after the engine is stopped, wherein said duct comprises a tubular structure having a side wall portion which is hinged at one side and pivoted to an opened position while said fuel supply devices are mounted through holes in an opposite side wall of the tubular structure.

23. A method as in claim 22 wherein said duct comprises an elastic tubular structure having holes and slits formed along at least one wall deforming said slits to pass mounted fuel supply devices therethrough into an interior of the tubular structure.

* * * * *